US009182704B2

(12) United States Patent
Matsumoto et al.

(10) Patent No.: US 9,182,704 B2
(45) Date of Patent: Nov. 10, 2015

(54) DEVELOPER CONVEYANCE DEVICE AND IMAGE FORMING APPARATUS HAVING A PUMP TO MOVE THE DEVELOPER IN A RELATIONSHIP WITH THE DEVELOPER CONTAINED IN A RESERVOIR

(71) Applicants: Junichi Matsumoto, Kanagawa (JP); Kiyonori Tsuda, Kanagawa (JP); Nobuo Takami, Kanagawa (JP); Yutaka Takahashi, Kanagawa (KR); Kentaro Mikuniya, Tokyo (JP)

(72) Inventors: Junichi Matsumoto, Kanagawa (JP); Kiyonori Tsuda, Kanagawa (JP); Nobuo Takami, Kanagawa (JP); Yutaka Takahashi, Kanagawa (KR); Kentaro Mikuniya, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 148 days.

(21) Appl. No.: 14/066,968

(22) Filed: Oct. 30, 2013

(65) Prior Publication Data

US 2014/0133889 A1 May 15, 2014

(30) Foreign Application Priority Data

Nov. 15, 2012 (JP) ..... 2012-251350
Aug. 19, 2013 (JP) ..... 2013-169834

(51) Int. Cl.
*G03G 15/08* (2006.01)

(52) U.S. Cl.
CPC ..... *G03G 15/0879* (2013.01); *G03G 15/0872* (2013.01)

(58) Field of Classification Search
CPC ..... G03G 15/0877; G03G 15/0879; G03G 15/0872
USPC ..... 399/258
See application file for complete search history.

(56) References Cited

U.S. PATENT DOCUMENTS

| | | | | |
|---|---|---|---|---|
| 7,010,249 | B2 * | 3/2006 | Hattori | 399/258 |
| 8,879,963 | B2 * | 11/2014 | Hirayama et al. | 399/258 |
| 2001/0052526 | A1 | 12/2001 | Kasahara et al. | |
| 2002/0164178 | A1 * | 11/2002 | Muramatsu et al. | 399/258 |
| 2007/0077098 | A1 | 4/2007 | Katsuyama et al. | |
| 2008/0038019 | A1 | 2/2008 | Kasahara et al. | |
| 2010/0290815 | A1 | 11/2010 | Ichikawa et al. | |
| 2010/0296847 | A1 | 11/2010 | Kurenuma et al. | |
| 2011/0044726 | A1 | 2/2011 | Katoh et al. | |
| 2012/0051792 | A1 | 3/2012 | Matsumoto et al. | |
| 2013/0266345 | A1 * | 10/2013 | Matsumoto et al. | 399/258 |

FOREIGN PATENT DOCUMENTS

| | | |
|---|---|---|
| JP | 2002-284345 | 10/2002 |
| JP | 2005-062648 | 3/2005 |

* cited by examiner

*Primary Examiner* — Susan Lee
(74) *Attorney, Agent, or Firm* — Oblon, McClelland, Maier & Neustadt, L.L.P.

(57) ABSTRACT

A developer conveyance device includes a developer reservoir for containing developer, and a positive-displacement pump to alternately generate positive pressure and negative pressure by varying a volume of space therein to transport developer from the developer reservoir to a destination. When Qp represents a volume of developer moved by a single pumping action of the pump, calculated by multiplying a maximum flow amount of the pump per unit time by an operation time of the pump; Qd represents a volume of developer contained in the developer reservoir; and Qe represents a volume of developer present in a virtual columnar space defined by vertically raising the developer outlet to a level of developer contained in the developer reservoir, either Qp>Qd or Qp>Qe is satisfied.

9 Claims, 8 Drawing Sheets

DEVELOPER CONVEYANCE DEVICE AND IMAGE FORMING APPARATUS HAVING A PUMP TO MOVE THE DEVELOPER IN A RELATIONSHIP WITH THE DEVELOPER CONTAINED IN A RESERVOIR

CROSS-REFERENCE TO RELATED APPLICATIONS

This patent application is based on and claims priority pursuant to 35 U.S.C. §119 to Japanese Patent Application Nos. 2012-251350, filed on Nov. 15, 2012, and 2013-169834, filed on Aug. 19, 2013, in the Japan Patent Office, the entire disclosure of each of which is hereby incorporated by reference herein.

BACKGROUND OF THE INVENTION

1. Technical Field

The present invention generally relates to a developer conveyance device to transport developer and further to an image forming apparatus, such as a copier, a printer, a facsimile machine, a plotter, or a multifunction peripheral (MFP) including at least two of coping, printing, facsimile transmission, plotting, and scanning capabilities, that includes a developer conveyance device.

2. Description of the Background Art

In image forming apparatuses, copiers, printers, facsimile machines, plotters, and MFPs, positive-displacement pumps are often used to transport developer consisting essentially of toner (toner particles) and carrier (carrier particles).

Positive-displacement pumps generate pressure by repeatedly varying the volume of space thereinside and use the pressure to draw in air or powder externally and then discharge the air or powder.

Examples of positive-displacement pumps include diaphragm pumps, piston pumps, and bellows pumps.

For example, JP-2005-062648-A proposes a configuration that employs a diaphragm pump to transport toner from a toner reservoir to a toner hopper disposed in an upper portion of a developing device.

Additionally, JP-2002-284345-A proposes a configuration that employs a uniaxial eccentric screw pump to suck in toner from a toner cartridge and transport toner to a developing device.

SUMMARY OF THE INVENTION

In view of the foregoing, one embodiment of the present invention provides a developer conveyance device that includes a developer reservoir for containing developer, and a positive-displacement pump to alternately generate positive pressure and negative pressure by varying a volume of space therein to transport developer from the developer reservoir to a destination.

In this configuration, Qp>Qd is satisfied when Qp represents a volume of developer moved by a single pumping action of the pump, and Qd represents a volume of developer contained in the developer reservoir. The volume Op is calculated by multiplying a maximum flow amount of the pump per unit time by an operation time of the pump.

Alternatively, a developer outlet is positioned in a bottom portion of the developer reservoir, and Qp>Qe is satisfied when Qp represents the volume of developer moved by the single pumping action of the pump; and Qe represents a volume of developer present in a virtual columnar space defined by vertically raising the developer outlet formed in the developer reservoir to a level of developer contained in the developer reservoir.

In another embodiment, an image forming apparatus includes an image bearer, a developing device to develop with developer an electrostatic latent image formed on the image bearer, and the above-described developer conveyance device.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
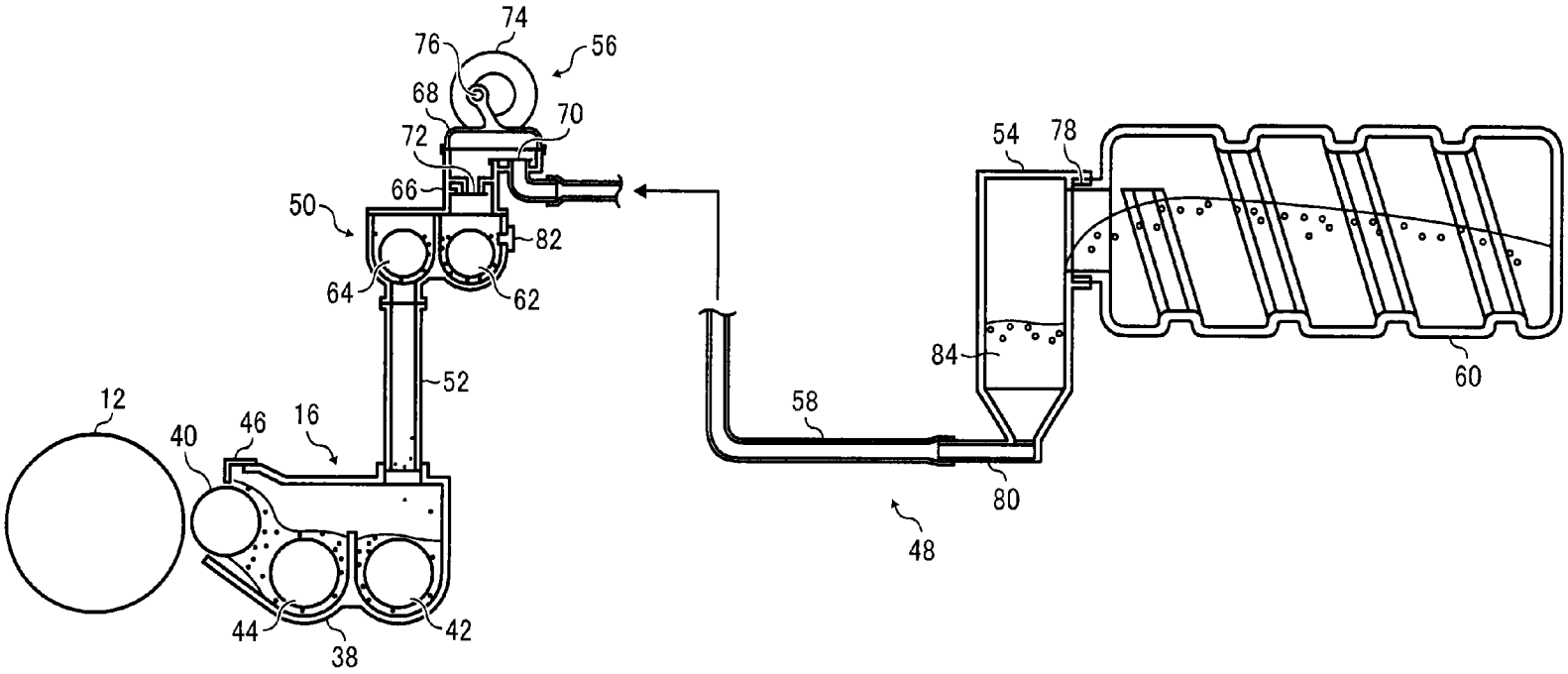
FIG. 1 is a schematic cross-sectional view of a developer conveyance device according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

It will be understood that if an element or layer is referred to as being "on," "against," "connected to" or "coupled to" another element or layer, then it can be directly on, against, connected, or coupled to the other element or layer, or intervening elements or layers may be present. In contrast, if an element is referred to as being "directly on", "directly connected to" or "directly coupled to" another element or layer, then there are no intervening elements or layers present.

Figure 9:
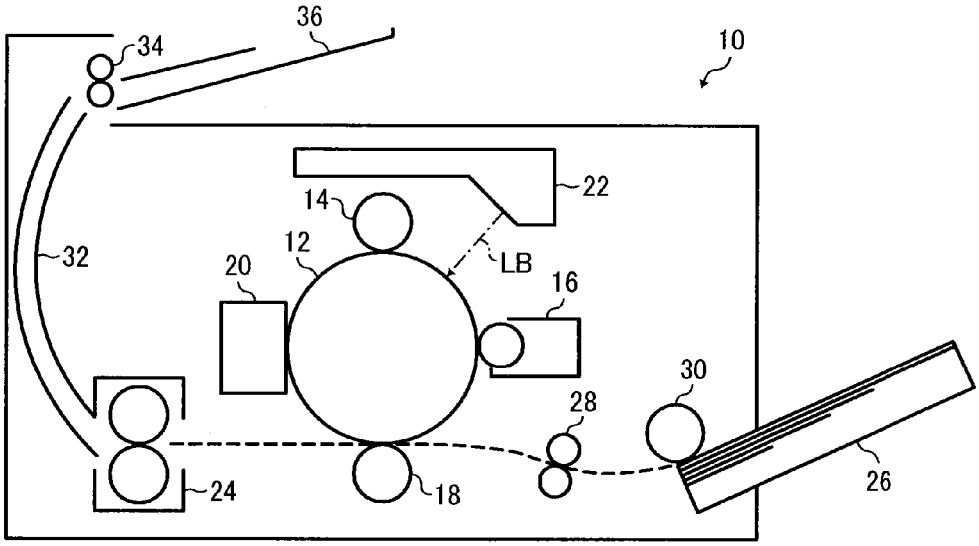
FIG. 9 is a schematic view illustrating an image forming apparatus to which the configurations shown in FIGS. 1, 2, and 4 to 8 are applicable.

Referring now to the drawings, wherein like reference numerals designate identical or corresponding parts throughout the several views thereof, and particularly to FIG. 9, an image forming apparatus according to an embodiment of the present invention is described.

An image forming apparatus 10 shown in FIG. 9 can be, for example, a laser printer. The image forming apparatus 10 includes a photoreceptor drum 12 serving as an image bearer. Around the photoreceptor drum 12, a charging roller 14 serving as a charging member, a developing device 16, a transfer roller 18, and a cleaning device 20 are provided.

Although the charging roller 14 used in the present embodiment is a contact-type charging member that generates a smaller amount of ozone, alternatively, a corona charger that uses corona electric discharge may be used instead.

An optical scanning device 22 provided in an upper portion of a body (hereinafter "apparatus body") of the image forming apparatus 10 is designed to expose the photoreceptor drum 12 with a laser beam LB at a position between the charging roller 14 and the developing device 16.

In FIG. 9, reference numerals 24 represents a fixing device, 26 represents a paper tray, 28 represents a pair of registration rollers, 30 represents a feed roller, 32 represents a sheet conveyance channel, 34 represents a pair of discharge rollers, and 36 represents a discharge tray.

In image formation, the photoreceptor drum 12 rotates clockwise in FIG. 9 at a constant velocity, and the charging roller 14 charges a surface of the photoreceptor drum 12 uniformly. Subsequently, the optical scanning device 22 exposes the surface of the photoreceptor drum 12 by directing the laser beam LB thereto. Thus, an electrostatic latent image is formed thereon.

The electrostatic latent image is a so-called negative latent image, and an image area is exposed. The developing device 16 reversely develops the electrostatic latent image. Thus, a toner image is formed on the photoreceptor drum 12.

The paper tray 26 contains sheets of recording media and removably installable in the apparatus body. In a state in which the paper tray 26 is installed in the apparatus body, the sheet on the top in the paper tray 26 is fed by the feed roller 30.

Then, a leading end of the sheet is clamped by the registration rollers 28. The registration rollers 28 transport the sheet to a transfer area, timed to coincide with the arrival of the toner image at a transfer position on the photoreceptor drum 12.

In the transfer area, the sheet is superimposed on the toner image, and the toner image is transferred onto the sheet by the action of the transfer roller 18.

Then, the toner image is fixed on the sheet by the fixing device 24, and the sheet is transported through the sheet conveyance channel 32 and discharged by the discharge rollers 34 to the discharge tray 36.

After the toner image is transferred therefrom, the surface of the photoreceptor drum 12 is cleaned, that is, toner and paper dust are removed therefrom, by the cleaning device 20.

As shown in FIG. 1, the developing device 16 includes a developer casing 38 to contain developer including toner and carrier, a developing roller 40 disposed in the developer casing 38, conveying screws 42 and 44 to agitate and transport developer, and a doctor blade 46.

The developing roller 40 magnetically retains agitated developer on its surface and supplies toner to the electrostatic latent image, thereby developing the electrostatic latent image into a toner image.

The doctor blade 46 regulates the thickness of developer (i.e., toner) on the surface of the developing roller 40.

A developer conveyance device 48 to supply toner thereto is connected to the developing device 16. It is to be noted that the developer conveyance device 48 is omitted in FIG. 9 for simplicity.

The developer conveyance device 48 includes a sub-hopper 50 to store toner temporarily and supply a constant amount of toner to the developing device 16, a toner supply channel 52 to connect together the sub-hopper 50 and the developer casing 38, and a toner reservoir 54 for containing developer or toner.

It is to be noted that, in FIG. 1, reference numeral 84 represents toner contained in the toner reservoir 54.

The developer conveyance device 48 further includes a diaphragm pump 56 and a conveyance channel 58. The pump 56 transports toner from the toner reservoir 54, which is a start point of conveyance, to the sub-hopper 50. The conveyance channel 58 connects together the toner reservoir 54 and the pump 56.

The pump 56 is a positive-displacement pump to alternately generate positive pressure and negative pressure by varying the volume of space therein. The sub-hopper 50 is an example of a destination of toner conveyance from the toner reservoir 54 by the pump 56.

A cylindrical toner bottle 60 is provided to the toner reservoir 54, together forming a single unit.

The sub-hopper 50 includes screws 62 and 64 to transport toner therein and supply a constant amount of toner to the developer casing 38.

Toner falls under the gravity through the toner supply channel 52 to the developer casing 38.

A side face of the sub-hopper 50 is provided with a toner end sensor 82 to detect that no toner remains or the amount of remaining toner is below a threshold.

The pump 56 includes a case 66, a diaphragm 68, a suction valve 70, and a discharge valve 72.

The diaphragm 68 is operated by a motor 74 and an eccentric shaft 76 directly connected to the motor 74.

A spiral groove is formed in an inner face of the toner bottle 60, and developer contained therein is discharged from the right to the left in FIG. 1 as the toner bottle 60 rotates.

The toner bottle 60 engages the toner reservoir 54 via a seal member 78 provided to an outer circumferential face of an end portion (i.e., around an outlet) of the toner bottle 60. In the configuration shown in FIG. 1, the end portion of the toner bottle 60 is fitted in the toner reservoir via the seal member 78.

The seal member 78 is an elastic member, such as sponge. When the toner bottle 60 rotates, the seal member 78 slidingly contacts the toner reservoir 54 and thus maintains the sealing.

The toner reservoir 54 is a space for temporarily store toner discharged from the toner bottle 60.

A nozzle 80 is formed at a lower end of the toner reservoir 54 in FIG. 1, and the toner reservoir 54 is connected to the conveyance channel 58 via the nozzle 80.

Next, supply of toner is described in further detail below.

When toner in the developer casing 38 of the developing device 16 is consumed in image development, a toner concentration detector provided to the developer casing 38 detects the concentration of toner therein.

According to the detection by the toner concentration detector, toner is supplied from the sub-hopper 50 to the developer casing 38 to supplement the toner consumption and keep the toner concentration constant.

When the amount of toner in the sub-hopper 50 falls below a predetermined amount, the toner end sensor 82 detects it.

The pump 56 is activated according to detection signals from the toner end sensor 82, and the pump 56 transports toner from the toner reservoir 54 to the sub-hopper 50.

Subsequently, the toner bottle 60 rotates, and toner is stored again in the toner reservoir 54.

For example, the toner end sensor 82 is a piezoelectric level sensor and detects that no or almost no toner remains therein when the level (surface) of powdered toner descends as the toner is consumed.

The diaphragm pump 56 according to the present embodiment can attain a maximum flow amount of 5 liters per minute, for example.

The term "maximum flow amount" used here means the amount of air sucked in or discharged per unit time in a state in which the pump 56 is empty.

It is regarded that the operation time of the pump 56 is 0.6 second per each pumping action.

Accordingly, with a single pumping action, a volume of 50 cubic centimeters (cc) at a maximum can be sucked in or discharged (5000/60×0.6).

Therefore, with a single pumping action, 50 cc of toner can be sucked in from the toner reservoir 54. In the present embodiment, however, the volume of toner contained in the toner reservoir 54 is limited to 50 cc or smaller.

In other words, the amount of toner contained in the toner reservoir 54 satisfies Qp>Qd wherein Qp represents the volume of developer (e.g., toner) moved by a single pumping action, that is, the volume calculated by multiplying the maximum flow amount per unit time by the operation time of the pump, and Qd represents the volume of developer contained in the toner reservoir 54.

The term "volume of toner" used in this specification means the volume of toner in a state in which air is present among toner particles and toner particles are stacked in multiple layers under their weights.

When positive-displacement pumps are used to transport power such as developer through a channel formed by a tube or pipe, the volume of the pump is changed, thereby changing pressure, to transport powder from a start point of conveyance.

The force for transporting developer varies in amount depending on the distance of transportation and lifting height (by which developer is lifted). The force increases as the distance and the lifting height increase.

The amount of force varies also depending on the condition of developer in the conveyance channel. That is, the amount of force increases as the amount of developer present in the conveyance channel increases.

When a positive-displacement pump is used, an amount of developer corresponding to the change in volume of the pump, caused by rotation of the pump, is moved from the developer container (i.e., a toner cartridge) through the nozzle to the conveyance channel and is transported to the developing device sequentially as the pump operates.

Accordingly, the conveyance channel is filled with developer.

If the conveyance channel is filled with developer, that is, a large amount of developer is present therein, the amount of force required for transporting developer increases, and it is necessary to increase the pressure generated by the pump.

To increase the capacity of a uniaxial eccentric screw pump, pump, for example, the size, the rotational frequency, or both of the pump are increased.

To increase the capacity of a diaphragm pump, it is necessary to increase the size of the pump, the stroke of the diaphragm, the frequency of rotation, and the like. Thus, the device becomes bulkier, and the cost increases.

For example, a case in which the volume of toner contained in the toner reservoir 54 is greater than 50 cc is described below.

When the volume of developer (toner) in the toner reservoir 54 is greater than the volume of developer moved by the single pumping action, accompanied by the pumping action, developer is transported from the toner reservoir 54 through the conveyance channel 58 by an amount identical or similar to the volume of developer moved by the single pumping action of the pump 56.

Accordingly, the conveyance channel 58 from the toner reservoir to the pump 56 is constantly filled with developer.

To move developer in this state, the amount of force (suction force) for moving all the developer present inside the conveyance channel 58 is required.

By contrast, when the volume Qd of developer at the conveyance start point is smaller than the volume Qp of developer moved by the single pumping action of the pump 56 (Qp>Qd), developer and air enter the conveyance channel 58 by the pumping action. Thus, a mixture of developer and air is present in the conveyance channel 58.

Therefore, compared with the state in which the conveyance channel 58 is filled with developer, the pressure of suction for moving developer can be lower. Further, if suction is executed in a state in which the conveyance channel 58 is densely filled with developer, it is possible that pressure and shearing force are applied to toner, causing toner to coagulate.

By contrast, when air is mixed in developer, toner is fluidized and less likely to coagulate. Thus, coagulation of toner can be inhibited.

More specifically, when the amount of toner is greater, 50 cc of toner is sucked in and transported from the toner reservoir 54 to the conveyance channel 58 by a single pumping action.

By repeating the pumping action, the conveyance channel 58 is gradually filled with toner, and then toner reaches the sub-hopper 50.

Accordingly, the conveyance channel 58 is densely filled with toner.

If the pump 56 is operated to transport the toner in this state, it is necessary to transport the entire toner occupying the conveyance channel 58.

That is, the load of the pump 56 increases as the amount of occupying toner increases.

By contrast, in the present embodiment, the toner reservoir 54 has a capacity of 50 cc or smaller for containing toner. For example, the capacity is 30 cc.

In this case, with a pumping action, the pump 56 transports 30 cc of toner to the conveyance channel 58 and sucks in 20 cc of air.

Accordingly, toner and air are present inside the conveyance channel 58 in a mixed state, and the force for transporting toner can be smaller compared with the state in which the conveyance channel 58 is densely filled with toner.

The load of a pump affects the operational life of the pump, and the operational life is shortened as the load increases. To secure a margin for the capacity of the pump to cope with the load, the pump is increased in size, thus increasing the cost.

Subsequently, as a preparation for subsequent pumping actions, 30 cc of toner is supplied from the toner bottle 60 to the toner reservoir 54. Thus, toner conveyance is repeated.

As described above, developer or toner can be transported efficiently when the volume of developer contained in the toner reservoir is smaller than the volume moved by the pumping action, that is, the volume of developer contained is limited.

Figure 3:
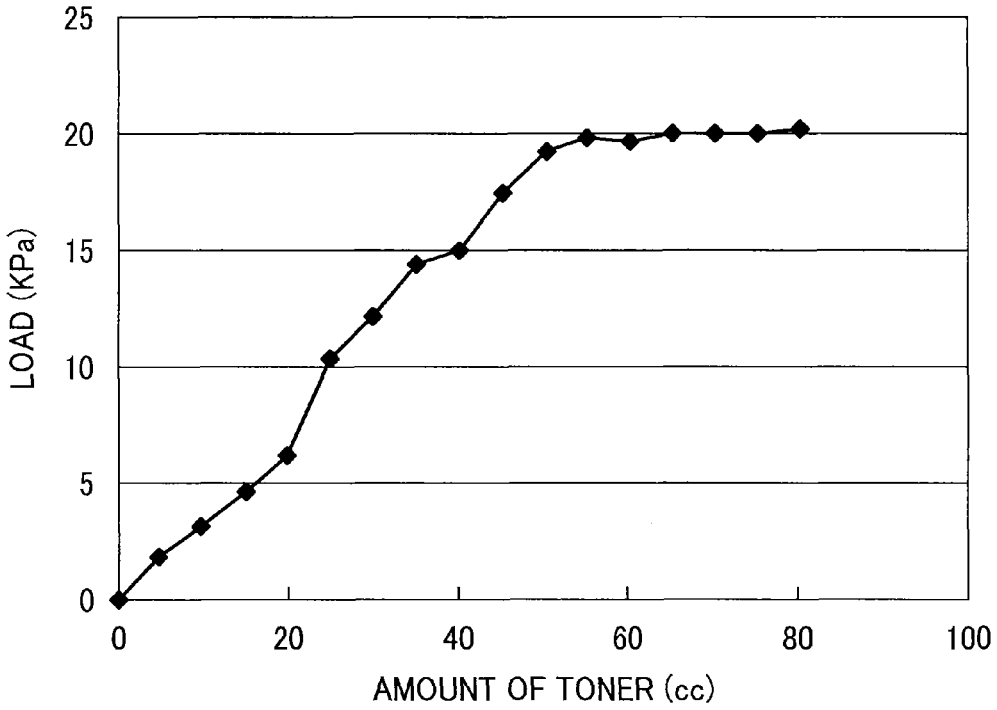
FIG. 3 is a graph illustrating an experimentally obtained relation between the amount of toner in the toner reservoir and the conveyance load.

FIG. 3 illustrates an experimentally obtained relation between the amount of toner in a toner reservoir and a conveyance load.

Figure 2:
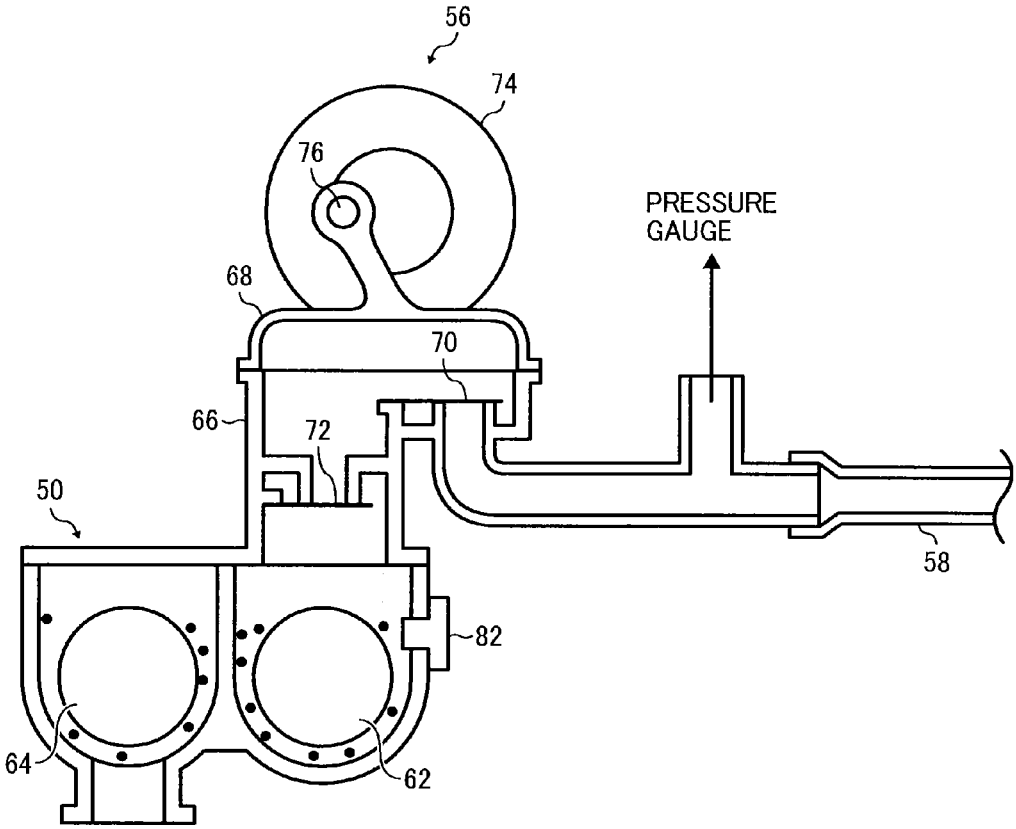
FIG. 2 is a schematic cross-sectional view of an area adjacent to a pump included in the developer conveyance device shown in FIG. 1 for understanding of the amount of toner in a toner reservoir and a conveyance load.

In an experiment, a pressure gauge was disposed at the position shown in FIG. 2, and pressure of the conveyance channel 58 at the time of toner conveyance was measured.

From the results shown in FIG. 3, it can be known that the conveyance load decreases as the amount of toner decreases. Although the conveyance load thus decreases as the amount of toner decreases, the amount of toner transported decreases. That is, the amount of air increases.

Since it results in an increase in time period for replenishing the sub-hopper 50 with toner increases, the amount of toner in the toner reservoir 54 is determined so that the replenishment amount can satisfy the toner consumption.

It is preferred that the amount of toner stored in the toner reservoir 54 be equals to or greater than an upper limit amount of toner consumed (consumption speed is expressed as the consumption divided by time) by the developing device 16.

Additionally, according to the present embodiment, air is contained together with toner inside the conveyance channel 58. Therefore, compared with a packed state, toner can be fluidized more easily when transported. Further, pressure and shearing force can be smaller, and the stress on toner can be smaller. This configuration is advantageous in inhibiting coagulation of toner.

Figure 4:
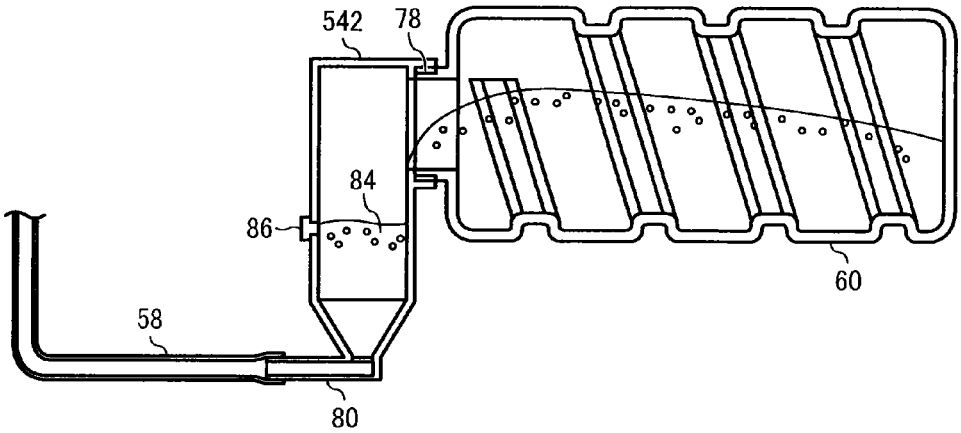
FIG. 4 is a schematic cross-sectional view of a main part of a developer conveyance device according to another embodiment.

FIG. 4 illustrates a developer conveyance device according to a second embodiment.

It is to be noted that components similar to those of the above-described embodiment are given identical or similar reference characters, and thus descriptions thereof omitted, which are similar to subsequent embodiments.

In the present embodiment, a toner reservoir 542 is provided with a toner end sensor 86 to detect the presence of toner therein.

The toner end sensor 86 is similar to the toner end sensor 82 provided to the sub-hopper 50.

The amount of toner inside the toner reservoir 542 is detected by the toner end sensor 86. Then, the amount of toner discharged from the toner bottle 60 is adjusted so that the volume Qd of toner inside the toner reservoir 542 does not exceed the volume Qp of developer moved by the single pumping action of the pump 56.

Since the amount of toner discharged by rotation of the toner bottle 60 fluctuates, it is preferred that the toner end sensor 86 be positioned (at a height) so that the toner end sensor 86 detects the amount smaller than an amount Qf that is a target to which the amount of toner in the toner reservoir 542 is adjusted (hereinafter "target amount Qf").

Specifically, the target amount Qf is a predetermined amount smaller than the volume Qp of developer moved by the single pumping action of the pump 56. The toner end sensor 86 is disposed at a position lower than the surface of toner (level of developer) in the amount equals to the target amount Qf.

With this arrangement, the amount of toner discharged to the toner reservoir 542 can be detected before the discharge amount reaches the volume Qp of developer moved by the single pumping action of the pump 56. This configuration can inhibit fluctuations in the amount discharged by rotation of the toner bottle 60 and excessive discharge (exceeding the volume Qp moved by the pump 56) resulting from a response delay in stopping the toner bottle 60.

It is to be noted that, although the toner end sensor 86 is disposed with reference to the predetermined target amount Qf (level of developer), alternatively, the position of the toner end sensor 86 may be set with reference to the volume Qp moved by the pump 56 so that the volume smaller than the Volume Qp can be detected.

Figure 5:
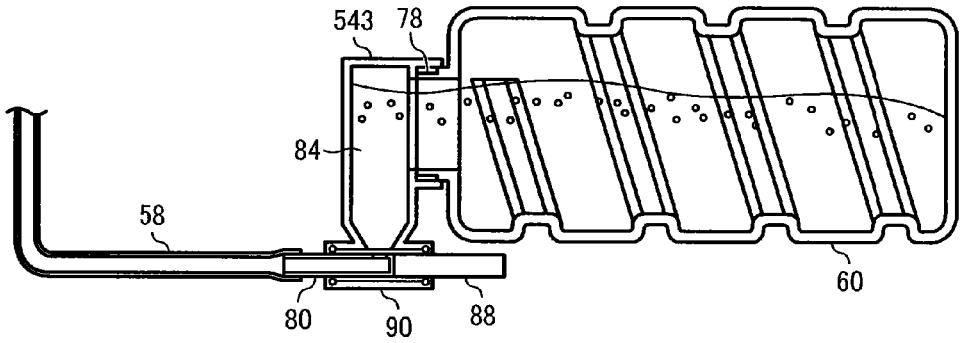
FIG. 5 is a schematic cross-sectional view of a main part of a developer conveyance device according to another embodiment.

FIG. 5 illustrates a developer conveyance device according to a third embodiment.

The present embodiment is characterized in that the capacity of a toner reservoir 543 is equal to or smaller than the volume Qp of developer moved by the single pumping action of the pump 56.

Additionally, the toner reservoir 543 is formed as a part of the toner bottle 60. Although the toner reservoir 543 is positioned in an upper part of the toner bottle 60 in FIG. 5, alternatively, the toner reservoir may be provided inside the toner bottle 60.

In a lower portion of the toner reservoir 543, a cylindrical plug 88, serving as a shutter, and a guide 90 to guide the shutter 88 are provided.

The shutter 88 is biased to the left in FIG. 5 by a spring or the like and engages the nozzle 80.

In accordance with the suction of the pump 56, the shutter 88 is moved to the right in FIG. 5 by a driving member and opens an opening (suction port) at the lower end of the toner reservoir 543.

Since the volume inside the toner reservoir 543 is smaller than the volume Qp moved by the pump 56, the amount of toner discharged by rotation of the toner bottle 60 is limited to the volume Qp or smaller.

This configuration can obviate the adjustment in the amount of toner discharged from the toner bottle 60.

This can be attained by rotating the toner bottle 60 to replenish the toner reservoir 543 with toner before the pumping action.

At that time, when the amount (i.e., speed) of toner discharge from the toner bottle 60 is equal to or greater than the toner conveyance speed of the pump 56, the toner reservoir 543 does not become empty.

Additionally, since the toner reservoir 543 and the toner bottle 60 are integrated with each other, the body of the developer conveyance device 48 (shown in FIG. 1) does not require a toner containing portion. Thus, the device can become compact.

Figure 6A:
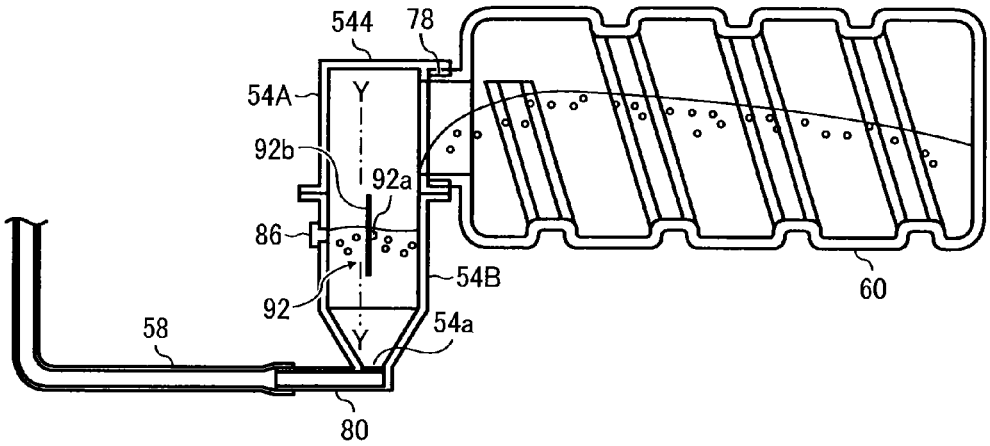
FIG. 6A is a schematic front view of a main part of a developer conveyance device according to another embodiment.
Figure 6B:
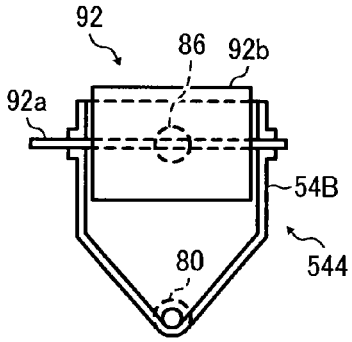
FIG. 6B is a side view along line Y-Y shown in FIG. 6A.

FIGS. 6A and 6B illustrate a developer conveyance device according to a fourth embodiment.

A toner reservoir 544 according to the present embodiment is characterized by including an agitator 92 to agitate toner therein.

The toner reservoir 544 includes an upper part 54A connected to the toner bottle 60 and a lower part 54B into which the nozzle 80 is integrated.

The agitator 92 is disposed in the lower part 54B. The agitator 92 includes a rotation shaft 92*a* rotatably supported by the lower part 54B and an agitation blade 92*b* that can be a thin plate and fixed to the rotation shaft 92*a*.

The rotation shaft 92*a* can be formed with metal, resin, or the like, and an end of the rotation shaft 92*a* is connected to a drive source such as a motor.

The agitator 92 is driven as follows.

1) The agitator 92 rotates a period identical or similar to the period during which the pump 56 operates when the pump 56 operates.

2) The agitator 92 rotates a period identical or similar to the period during which the toner bottle 60 rotates when the toner bottle 60 rotates.

Since the agitator 92 can mix air in developer contained in the toner reservoir 544 and fluidize the developer, the suction load of the pump 56 can be reduced. Simultaneously, developer can easily gather to a suction port 54*a*, serving as a developer outlet, positioned in the lower portion of the toner reservoir 544.

Additionally, developer can be inhibited from being packed when the image forming apparatus 10 is left unused for a long time, and thus increases in the suction load can be inhibited.

Additionally, in the toner reservoir 544 shaped as shown in FIGS. 6A and 6B, cross-linking of developer can occur due to its adherent property.

Therefore, it is possible that only developer adjacent to the suction port 54*a* is sucked in, and developer adjacent to the wall of the toner reservoir 544 is retained.

However, such retention of developer can be inhibited by the agitator 92.

When agitator 92 rotates simultaneously with rotation of the toner bottle 60, the agitator 92 can agitate developer falling from the toner bottle 60 and keep the level of powdered developer horizontal.

Thus, the toner end sensor 86 can detect the level of developer properly.

Figure 7:
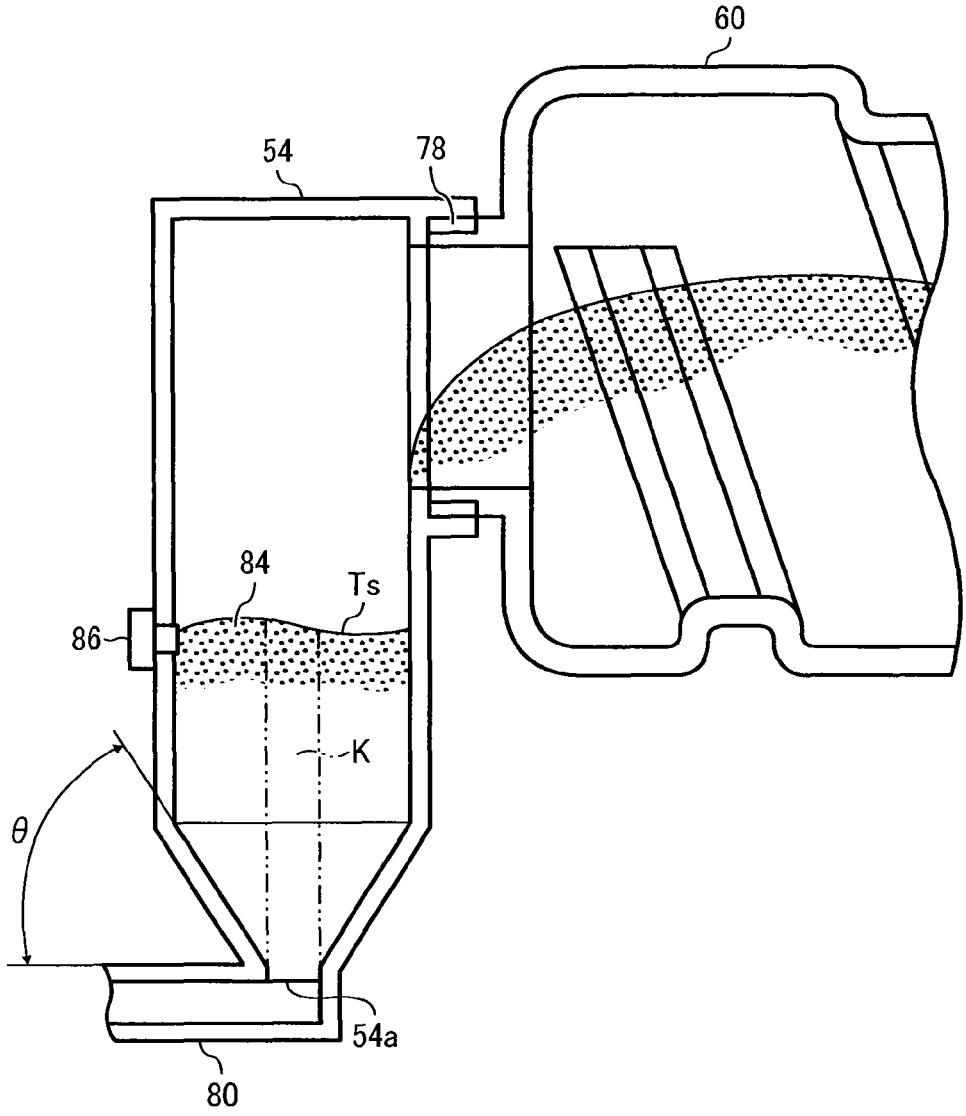
FIG. 7 is a schematic cross-sectional view of a main part of a developer conveyance device according to another embodiment.
Figure 8:
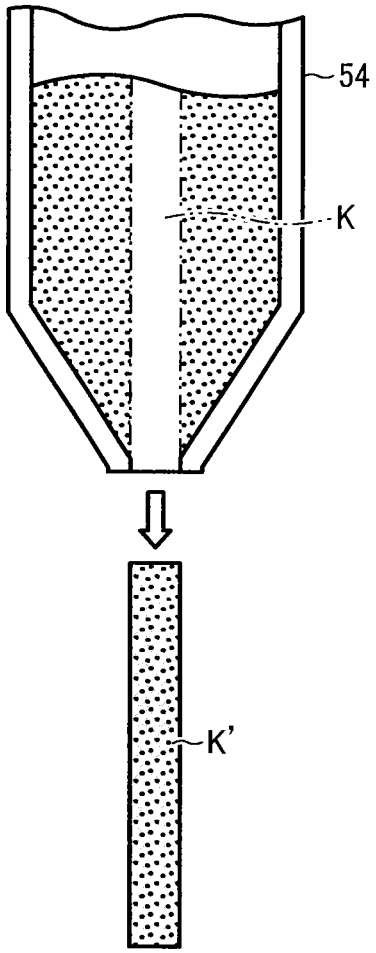
FIG. 8 is a schematic view for understanding of a principle to suck in toner using the configuration shown in FIG. 7.

FIGS. 7 and 8 illustrate a developer conveyance device according to a fifth embodiment.

In the above-described embodiments, the volume Qd of developer contained in the toner reservoir 54 is smaller than the volume Qp moved by the pump 54 (Qp>Qd), or the toner reservoir 54, 542, 543, and 544 (also collectively "toner reservoir 54") is designed to have a capacity equal to or smaller than the volume Qp.

That is, all of toner present in the toner reservoir 54 is sucked in by a single pumping action.

According to an experiment performed by inventors of the present invention, in the case of viscous toner such as toner having a low melting point, even when the amount of toner in the toner reservoir 54 is greater than the volume Qp moved by the pump 56, only the toner affected by the suction force exerted by the pump 56 is locally sucked in when the pump 56 is operated.

In other words, even if a volume of toner greater than the volume Qp is contained in the toner reservoir 54, a volume of toner smaller than the volume Qp can be sucked in locally.

The principle is described with reference to FIG. 7.

In FIG. 7, the suction port 54*a*, a narrowest opening on the discharge side of the toner reservoir 54, serves as a bottom face, reference character Ts represents a level (powder surface) of developer contained in the toner reservoir 54, and reference character K represents a virtual columnar space defined by raising the bottom face vertically to the powder level Ts.

The virtual columnar space K is cylindrical when the bottom shape is circular and prismatic when the bottom shape is rectangular.

When Qe represents the volume of toner present in the virtual columnar space K, Qp>Qe is satisfied.

With a single pumping action, as shown in FIG. 8, toner in the virtual columnar space K, as a block, is sucked in locally. For ease of understanding, toner drawn into the nozzle 80 is schematically illustrated as a columnar block K'.

In practice, toner is not neatly drawn out from the virtual columnar space K in a columnar block, but adjacent toner is also drawn due to friction among toner particles or the like. However, it is experimentally confirmed that the amount of toner sucked in is substantially identical to the volume Qe inside the virtual columnar space K defined by the bottom face (i.e., suction port 54*a*) and the height (distance to the powder level Ts).

Accordingly, even when the amount of toner in the toner reservoir 54 is greater than the volume Qp moved by the pump 56, the volume Qe of toner smaller than Qp (Qp>Qe) can be sucked in.

To reduce the amount of adjacent toner drawn together with the toner in the virtual columnar space K and precisely suck in the toner present in the virtual columnar space K, it is preferred that the lower portion of the toner reservoir 54 is tapered an angle θ greater than an angle of repose as shown in FIG. 7.

In the present embodiment, it is preferred that the toner end sensor 86 be positioned (at a height) so that the toner end sensor 86 detects the amount smaller than the target amount Qf from the viewpoints similar to those described with reference to FIG. 2.

In other words, the detection position of the toner end sensor 86 is lower than the upper face of the virtual columnar space K (the powder surface corresponding to the virtual columnar space K).

Specifically, the height (i.e., upper face) of the virtual columnar space K that satisfies Qp>Qe can be known preliminarily. By disposing the toner end sensor 86 lower than that height, excessive discharge (exceeding the volume Oe) can be inhibited similarly to the above-described embodiment.

Alternatively, the toner end sensor 86 may be disposed with reference to the volume Qp moved by the pump 56 so that the volume smaller than the Volume Qp is detected, similarly to the above-described embodiment.

The agitator 92 can be provided in the present embodiment, similarly to the fourth embodiment.

After the pump 56 is activated and toner present in the virtual columnar space K is sucked in, the toner bottle 60 rotates. Then, toner is supplied to the toner reservoir 54. Subsequently, the agitator 92 rotates, and thus the toner in the toner reservoir 54 is agitated. The powder surface is leveled.

As described above, according to various aspects of the present specification, independently or in combination, conveyance load to transport developer can be reduced, conveyance efficiency can be enhanced, and the device can become compact. Additionally, the operational life of the developer conveyance device and further the image forming apparatus including the device can be extended.

It is to be noted that, although the above-described embodiments concern the image forming apparatus including a single image bearer (photoreceptor drum), the various aspects thereof can adapt to tandem image forming apparatuses including multiple image bearers.

In such a configuration, the developing device is provided for each image bearer, and the developer conveyance device is provided for each developer conveyance device.

Numerous additional modifications and variations are possible in light of the above teachings. It is therefore to be understood that, within the scope of the appended claims, the disclosure of this patent specification may be practiced otherwise than as specifically described herein.

What is claimed is:

1. A developer conveyance device comprising:

a developer reservoir for containing developer; and a positive-displacement pump to alternately generate positive pressure and negative pressure by varying a volume of space therein to transport developer from the developer reservoir to a destination, wherein Qp>Qd is satisfied when Qp represents a volume of developer moved by a single pumping action of the pump, the volume Qp obtained by multiplying a maximum flow amount of the pump per unit time by an operation time of the pump, and Qd represents a volume of developer contained in the developer reservoir.

2. The developer conveyance device according to claim 1, further comprising a developer detector to detect presence of developer in the developer reservoir.

3. The developer conveyance device according to claim 2, wherein the developer detector is disposed to detect an amount of developer smaller than the volume Qp of developer moved by the single pumping action of the pump.

4. The developer conveyance device according to claim 1, wherein an inner volume of the developer reservoir is equal to or smaller than the volume Qp of developer moved by the single pumping action.

5. The developer conveyance device according to claim 1, further comprising a developer container that is removably installable to the developer conveyance device and configured to contain developer supplied to the developer reservoir, wherein the developer container and the developer reservoir are united together.

6. The developer conveyance device according to claim 1, further comprising an agitator to agitate developer in the developer reservoir.

7. An image forming apparatus comprising:

an image bearer;

a developing device to develop with developer an electrostatic latent image formed on the image bearer;

and the developer conveyance device according to claim 1 to supply developer to the developing device.

8. A developer conveyance device comprising:

a developer reservoir for containing developer, the developer reservoir having a developer outlet positioned in a bottom portion of the developer reservoir; and a positive-displacement pump to alternately generate positive pressure and negative pressure by varying a volume of space therein to transport developer from the developer reservoir to a destination, wherein Qp>Qe is satisfied when Qp represents a volume of developer moved by a single pumping action of the pump, the volume Qp obtained by multiplying a maximum flow amount of the pump per unit time by an operation time of the pump, and Qe represents a volume of developer present in a virtual columnar space defined by vertically raising the developer outlet to a level of developer contained in the developer reservoir.

9. An image forming apparatus comprising:

an image bearer;

a developing device to develop with developer an electrostatic latent image formed on the image bearer;

and the developer conveyance device according to claim 8 to supply developer to the developing device.

* * * * *

UNITED STATES PATENT AND TRADEMARK OFFICE

CERTIFICATE OF CORRECTION

PATENT NO. : 9,182,704 B2
APPLICATION NO. : 14/066968
DATED : November 10, 2015
INVENTOR(S) : Junichi Matsumoto et al.

It is certified that error appears in the above-identified patent and that said Letters Patent is hereby corrected as shown below:

On the title page, Item (71), the 4th Applicant's Country Code is incorrect and Item (72), the 4th Inventor's Country Code is incorrect. Item (71) and Item (72) should read:

--(71) Applicants: Junichi Matsumoto, Kanagawa (JP);
Kiyonori Tsuda, Kanagawa (JP);
Nobuo Takami, Kanagawa (JP);
Yutaka Takahashi, Kanagawa (JP);
Kentaro Mikuniya, Tokyo (JP)

(72) Inventors: Junichi Matsumoto, Kanagawa (JP);
Kiyonori Tsuda, Kanagawa (JP);
Nobuo Takami, Kanagawa (JP);
Yutaka Takahashi, Kanagawa (JP);
Kentaro Mikuniya, Tokyo (JP)--

Signed and Sealed this
Twelfth Day of July, 2016

Michelle K. Lee

Michelle K. Lee
*Director of the United States Patent and Trademark Office*